US006344604B1

(12) United States Patent
Schmidt

(10) Patent No.: US 6,344,604 B1
(45) Date of Patent: Feb. 5, 2002

(54) PAD, PAD HOLDER AND FASTENER FOR WOODWIND MUSICAL INSTRUMENTS

(76) Inventor: James Edward Schmidt, 4480 N. Academy, Sanger, CA (US) 93657

( * ) Notice: Subject to any disclaimer, the term of this patent is extended or adjusted under 35 U.S.C. 154(b) by 0 days.

(21) Appl. No.: 09/608,432

(22) Filed: Jun. 30, 2000

Related U.S. Application Data

(60) Provisional application No. 60/142,424, filed on Jul. 6, 1999.

(51) Int. Cl.[7] ..... G01D 7/08
(52) U.S. Cl. ..... 84/385 P
(58) Field of Search ..... 84/385 P

(56) References Cited

U.S. PATENT DOCUMENTS

| | | | | | |
|---|---|---|---|---|---|
| 4,158,979 | A | * | 6/1979 | Suzuki | 84/385 P |
| 4,453,444 | A | * | 6/1984 | Valentino | 84/385 P |
| 4,704,939 | A | | 11/1987 | Straubinger | |
| 4,798,122 | A | * | 1/1989 | Gisler et al. | 84/385 P |
| 5,381,718 | A | * | 1/1995 | Wasser | 84/385 P |
| 5,417,135 | A | * | 5/1995 | Straubinger | 84/385 P |
| 5,469,771 | A | * | 11/1995 | Wasser | 84/385 P |
| 5,717,151 | A | * | 2/1998 | Straubinger | 84/385 P |
| 5,900,562 | A | * | 5/1999 | Smeding | 84/385 P |
| 6,028,256 | A | * | 2/2000 | Straubinger | |

* cited by examiner

*Primary Examiner*—Shih-Yung Hsieh

(57) ABSTRACT

A pad for closure of a musical wind instrument tonehole. The pad consists of a cushion that is contained within a rigid holder that has a recess with a lip (lips) or angular, constricting lateral side (sides) to secure the cushion within the holder. A notch is provided in the cushion's rigid holder that allows a tool to be inserted in order to pry out the cushion from the cushion holder so that shims may be easily installed and adjusted to obtain a precise seal between the pad surface and the tonehole rim. The shimming procedure can be performed without having to remove the cup/key and the pad from the wind instrument. An improved way of shimming pads, such as flute pads, by providing a pad fastening device which does not require removal of the pad closing mechanism from the instrument body. This is achieved by replacing the usual pad retining screw with a magnet that can easily be removed and replaced with a tweezers. The tone or acoustical properties of various pad materials and their manner of construction is of considerable importance. Reducing the detrimental sound absorbing qualities of pads by adhering a slick sealing surface directly to the underlying cushion further enhances the tone qualities of wind instruments.

16 Claims, 7 Drawing Sheets

PAD, PAD HOLDER AND FASTENER FOR WOODWIND MUSICAL INSTRUMENTS

This application claims the benefit of Provisional Patent Application Ser. No. 60/142,424 filed Jul. 16,1999.

BACKGROUND OF THE INVENTION

The present invention is an improvement over conventional musical wind instrument pads that have a tendency to warp and lose their seal. Conventional pads have a thin skin that is not durable and often wears through because of repeated contact with the tonehole rim, thus ruining the seal. Conventional pads are usually made of materials which change dimension due to absorption of water and/or subsequent drying out. Because of this they are not stable and lose their seal against a tonehole rim as their dimensions change. Because of these problems it is often necessary to replace conventional pads.

The circumferential edges of the toneholes of musical wind instruments are not always flat or in plane, so shims or partial shims (which do not complete a circle) are necessary to adjust the surface plane of the pad so that it matches the plane or variations in plane of the circumferential edge of the tonehole. In this way a good pad seal can be accomplished without having to use excessive finger pressure to close the pad. This is one important factor that makes a difference between a musical instrument that plays well and one that plays poorly. Conventional wind instruments such as flutes usually employ shims between the pad and the cup. The common method of shimming conventional pads requires the removal of the cup/key from the instrument body, removal of the pad retaining screw and washer, removal of the pad from the cup, and finally installing shims. The conventional pad and key must then be reassembled and refitted to the instrument. The labor involved is tedious and expensive. The present invention offers a way to reduce this cost and labor.

Some wind instruments (especially saxophones) use glue such as shellac to adhere the pad to the cup. The glue is heated to soften it while the pad is adjusted/tilted in the cup to achieve a better seal or match between the pad and the circumferential edge of the tonehole. This may be a good method for approximating the fit between the sealing surface and the tonehole rim, but it is hard to determine exactly how much to relocate the pad while the glue is still soft. The process can be erratic and the pad can be moved too much, not enough, or in the wrong direction. Shimming is a more accurate process because a shim of a measured thickness can be placed exactly where it will be most effective. Then, if you decide that the seal was better without the shim, the shim can be removed and the pad will be exactly as it was before the shim was added.

The ability to easily shim a pad is very important. The present invention addresses this issue and provides an improvement by making it possible to shim the pad without having to remove the cup/key from the instrument body. The advantages due to reduced labor help to make this new invention attractive to the musical instrument industry and to its customers.

Most pads used in wind instruments consist of a soft cushion that is covered with a skin where the pad surface meets the tonehole rim. The soft, compliant nature of the cushion reduces excessive impact noise when the pad is closed against the tone hole and also allows the pad to conform to the circumferential rim of the tonehole, thus creating a seal. Unfortunately, this softness has the detrimental effect of absorbing and deadening the tone of the wind instrument. Stretching the skin over the soft cushion has a further detrimental effect because there are tiny spaces between the skin and the cushion created by elevations and recesses of the underlying cushion due to the surface texture of cushion materials such as felt or ULTRASUEDE. Because the skin spans across these tiny recesses and is unsupported, the skin is allowed to flex in sympathy with the sound producing vibrations and pulsations of the air moving within the musical instrument while it is being played. This flexing of the pad skin is undesirable because it dampens and weakens the intensity of the sound vibrations and pulsations previously mentioned.

Conventional pads commonly have a surface skin that is wrapped around the cushion and glued to its back side. Stretching and wrapping the skin around the cushion distorts the pad because of varying/uneven levels of stress and tension being applied to the outside diameter of the cushion. This distortion warps the exposed surface of the pad, bringing it out of plane. An out of plane pad surface creates unwanted air leaks between the sealing surface and the tone hole rim. Extra labor and expense must then be invested to eliminate these unwanted air leaks. Another problem with conventional pads is that the skin usually ends up being folded or bunched up in places where it is glued to the back side of the pad. This creates an uneven layer of glued skin and causes the back surface of the pad to be uneven and out of plane. Since the backside of the pad is pressed against the inside of the cup when assembled, any unevenness distorts the entire pad to some degree and causes problems in obtaining a seal between the pad surface and the tonehole rim.

BRIEF SUMMARY OF THE INVENTION

The invention described herein incorporates several materials which combine to make a pad which is long lasting, dimensionally stable in respect to water absorption or content, and easy to adjust by shimming in order to maintain a good sealing/mating surface with the tonehole rim.

The pad is comprised of a compliant cushion that has a smooth and flexible surface. A recess is formed in the rigid holder of the cushion for the purpose of containing the compliant cushion. In order to retain the cushion within the cushion holder recess, one or more lateral sides of the recess may be angular and/or lipped so that the portion of the cushion material nearer to the tonehole sealing surface is constricted and held more tightly than the portion of the cushion material embedded within the area of the recess that is farther away from the tonehole sealing surface.

A notch is provided in the outer collar of the cushion holder to enable a wire, pick or similar tool to be inserted between the cushion and the cushion holder for the purpose of prying the cushion out of the recess. In this way the pad can be easily lifted so that a shim may be inserted between the cushion and the cushion holder to close leaks and provide a more precise seal with the tonehole rim. With this new pad design it is possible to perform the shimming operation without having to remove the cup/key from the instrument body, thus saving time and expense when setting up a pad-to-tonehole seal.

An improved way of shimming pads is by providing a pad-fastening device that does not require removal of the pad closing mechanism from the instrument body. This is achieved by replacing the usual pad retaining screw with a magnet that can easily be removed and replaced with a tweezers.

The tone or acoustical properties of various pad materials and their manner of construction is of considerable importance. Reducing the detrimental sound absorbing qualities of pads by adhering a slick sealing surface directly to the underlying cushion further enhances the tone qualities of wind instruments. The thin sealing surface can be made of a variety of materials such as films with polymeric structures, gut skin, leather or other. Polymerically structured films are impervious to air, provide an airtight seal and are unaffected by moisture. Adhering the sealing surface or film to the pad cushion offers an advantage in that the sealing surface does not have to wrap, stretch and distort around the cushion to be glued to the backside of the pad. Adhering the sealing surface directly to the underlying cushion helps to create a pad that has a flat surface free of distortion. For a better understanding of the present invention, a preferred embodiment is shown in the accompanying drawings and is described as follows:

DETAILED DESCRIPTION OF THE PRESENT INVENTION

The invention described herein incorporates several materials which combine to make a pad which is long lasting, dimensionally stable in respect to water absorption or content, and easy to adjust by shimming in order to maintain a good sealing/mating surface with the tonehole rim.

Figure 3:
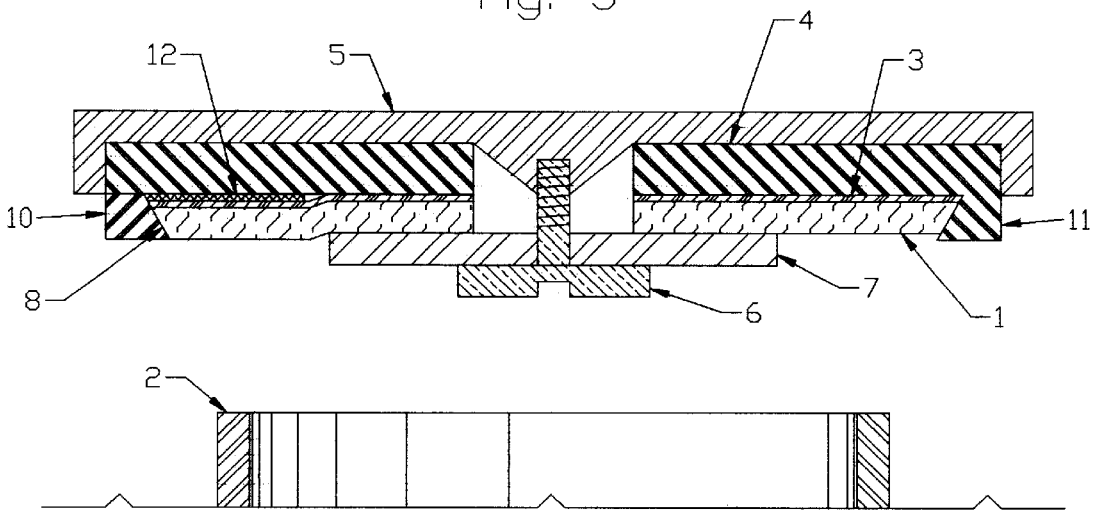
FIG. 3 shows another embodiment of the invention that uses a combination of angled retaining lips along with a washer and screw for the purpose of retaining the cushion within the cushion holder recess.
Figure 4:
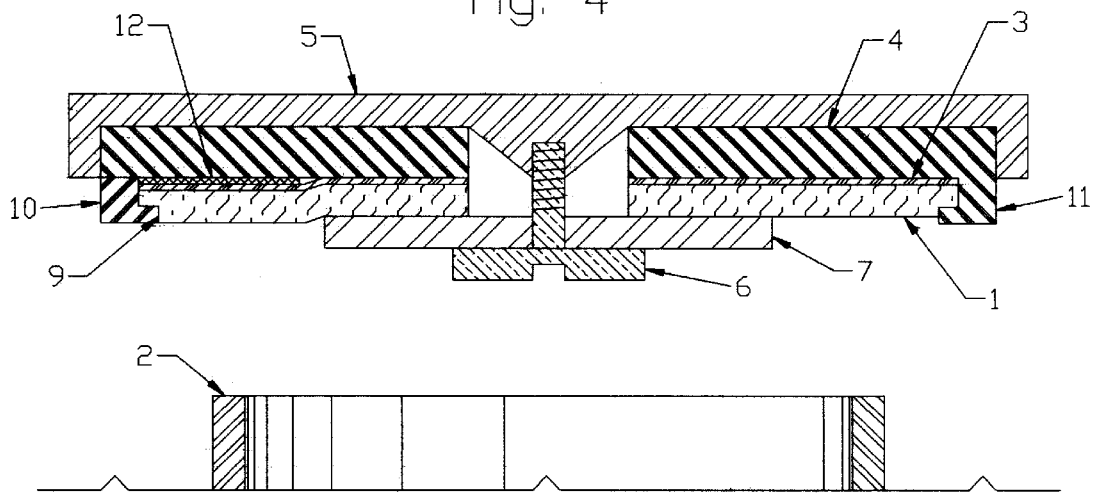
FIG. 4 is similar to FIG. 3 and shows a cushion holder that uses an outer retaining lip on the side of the recess along with a washer and screw for the purpose of retaining the cushion within the cushion holder recess.

Referring to FIGS. 3 and 4, the pad is comprised of a compliant cushion 1 such as felt or other material that has a smooth and flexible surface to seal against a tone hole rim 2. ULTRASUEDE is the trademark name for a suitable cushion material that is a fabric made of 100% polyester ultra-microfiber non-woven with non-fibrous polyurethane binder. PORON is a trademark name for another suitable cushion material in the form of an elastic open cell polyurethane foam that is comprised of a blend of polyether and polyester. Some of these materials may be covered with a sealing surface. A recess is formed in the rigid holder 4 of the cushion for the purpose of containing the compliant cushion 1. In order to retain the cushion within the cushion holder recess, one or more lateral sides of the recess may be angular and/or lipped 9 so that the portion of the cushion material tonehole sealing surface is constricted and held more tightly than the portion of the cushion material embedded within the area of the recess that is farther away from the tonehole sealing surface. The exposed portion of the cushion material 1 is thus pinched while the roomier embedded area of the cushion holder recess allows lateral space for the stiff backing of the cushion 3. A cushion holder 4 may be held within a cup 5 or key of a wind instrument by a rivet or screw 6 and washer 7 or glue or other means. In some cases the cushion holder and cup may be made out of the same material. They may even be of the same part and be made out of continuous material. For instance, the cushion holder recess may be formed within the cup 5 itself by machining, casting or other method. The back side of the pad (side opposite the tonehole) is adhered to a stiff material 3 such as polyester film. The purpose of the backing is to stiffen the flexible condition of the cushion 1 so that it will remain trapped within the constrictive shape of the cushion holder recess. I have found through testing under normal wind instrument playing conditions that soft, flexible cushion materials without the backing previously mentioned can migrate out of the cushion holder recess. The stiff backing 3 of the cushion is not completely rigid and can be forced (using a pick or similar tool) in and out of the recess of the cushion holder. The backing 3 of the cushion should be flexible enough to conform to the various altered elevations or changes in plane caused by the addition or subsequent removal of shims or partial shims 12. The stiffness of the backing material 3 is most useful in maintaining a constant inside and outside diameter which ensures a pad's desired fit and retention within the pad cushion holder's recess 4.

Figure 5A:
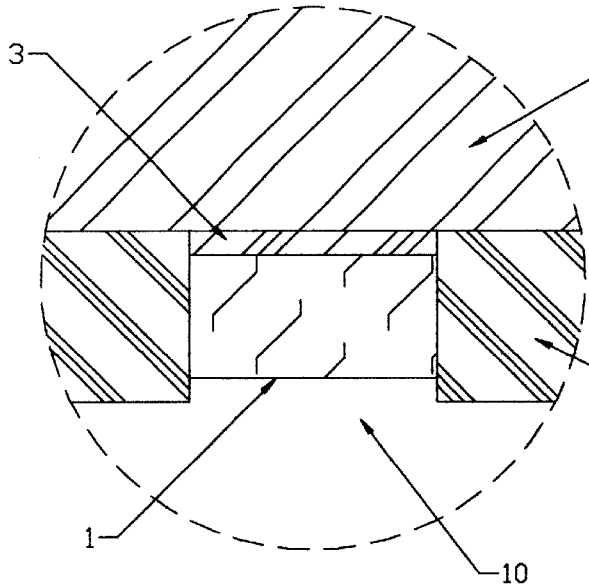
FIG. 5*a* is an enlarged portion of FIG. 5 showing the cup, exposed portion of the cushion holder, notch, and an exposed portion of the shim and cushion.
Figure 5:
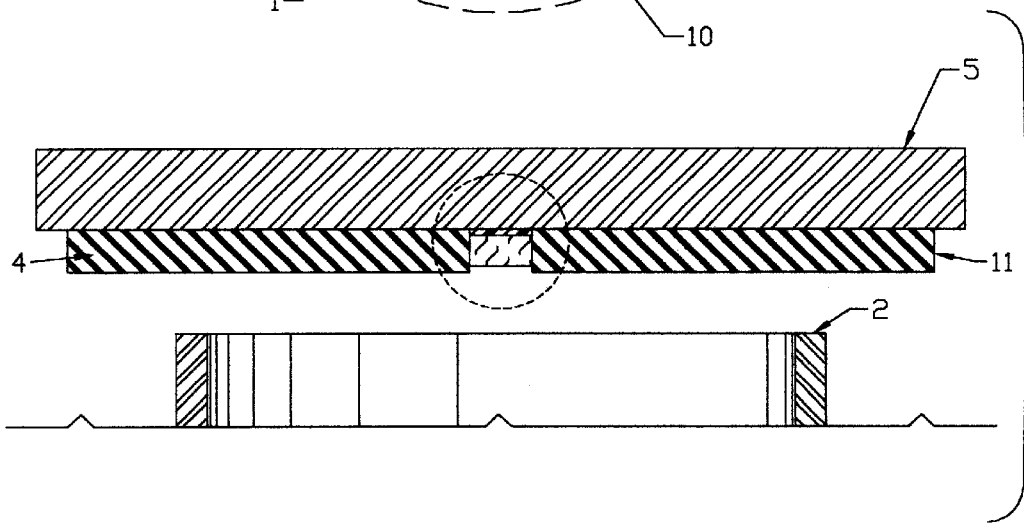
FIG. 5 is a side view with enlarged portion showing the cup, exposed portion of the cushion holder, notch, and an exposed portion of the shim and cushion.

Referring to FIG. 5, a notch 10 is provided in the outer collar 11 of the cushion holder 4 to enable a wire, pick or similar tool to be inserted between the cushion and the cushion holder for the purpose of prying the cushion out of the recess. In this way the pad can be easily lifted so that a shim may be inserted between the cushion and the cushion holder 4 thus elevating the pad to close leaks and provide a more precise seal with the tonehole rim 2. With this novel pad design it is possible to perform the shimming operation without having to remove the cup/key from the instrument body, thus saving time and expense when setting up a pad-to-tonehole seal.

Figure 6:
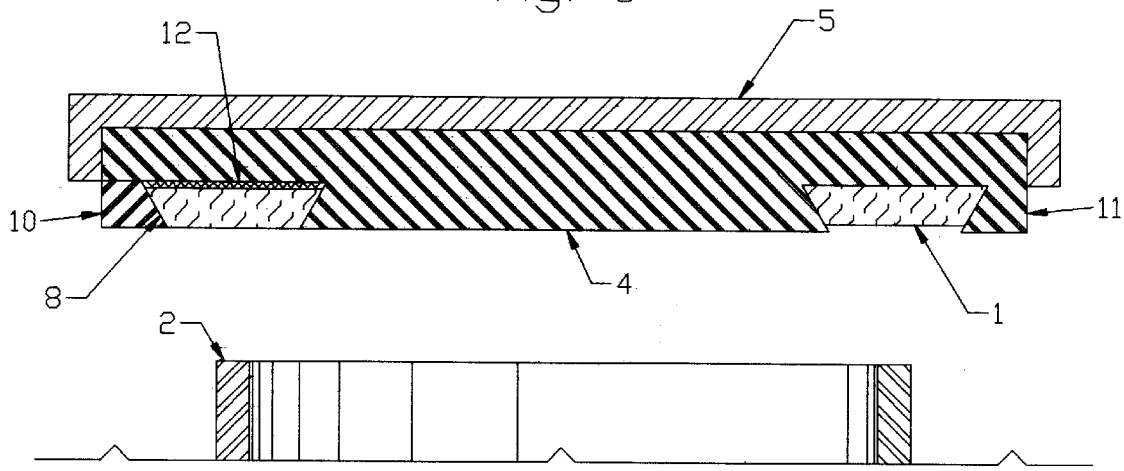
FIG. 6 is similar to FIG. 1 and illustrates an embodiment of the invention wherein the cushion is without a backing.

Referring to FIG. 6, a material or combination of materials may be used for the cushion 1 which does not have a backing but is still retained within the recess of the cushion holder 4 by virtue of the retaining lip 9 or constricting angle of the lateral sides of the cushion recess. It may be possible to eliminate the cushion backing by substituting a cushion material comprised of different layers of various densities and replacing the backing with a stiffer and/or denser layer of cushion material. The cushion 1 may be of continuous material, each different area of density or stiffness blending smoothly into the next. The denser and/or stiffer area may replace the backing 3 as previously mentioned.

Referring again to FIGS. 3 and 4, the outer diameter only of the cushion recess may be provided with a constricting side angle or lip 9 to retain the outside diameter portion of the cushion while the middle area of the cushion is retained by a washer 7 and fastening device 6. Most flutes and saxophones employ a retaining washer 7 or resonator to hold the pad in place and to provide enhanced sound wave reflection. Even with a washer 7 or resonator installed on one of these novel pads it is still possible to pry the outer diameter of the cushion 1 from the cushion holder 4 and insert a partial shim 12 (partial shims do not complete a circle) between the cushion and the cushion holder for the purpose of sealing a leak caused by a gap or mismatch between the pad surface and tonehole rim 2. The cushion is then easily replaced by pushing it back into the recess of the cushion holder. This process is easier than having to remove the entire key from the instrument body in order to shim the pad as is commonly performed with conventional instruments.

Figure 7:
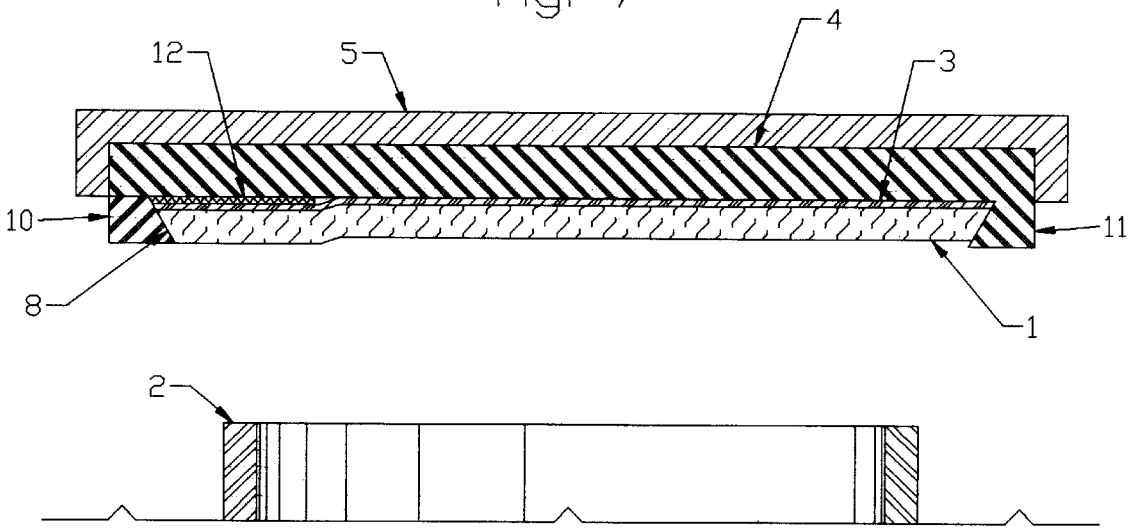
FIG. 7 illustrates a version of the invention that uses only the outer angular lip to retain the cushion within the cushion holder recess.
Figure 8:
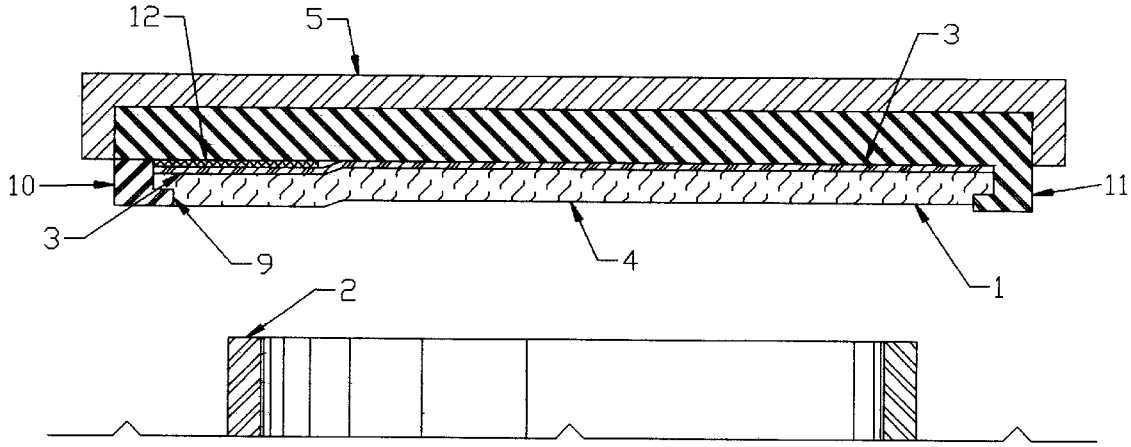
FIG. 8 is similar to FIG. 7 but shows a lip on the side of the recess that is used to retain the cushion within the cushion holder recess.
Figure 9:
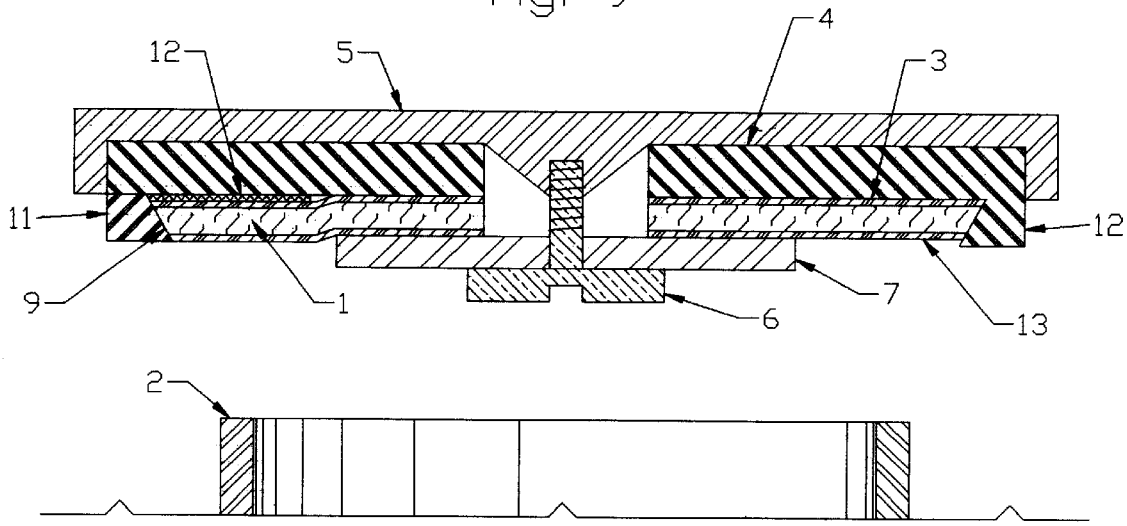
FIG. 9 is similar to FIG. 3 and shows a sealing surface that is adhered to the cushion that is in turn held in the cushion holder recess by the angular lips and a retaining washer and screw.
Figure 10:
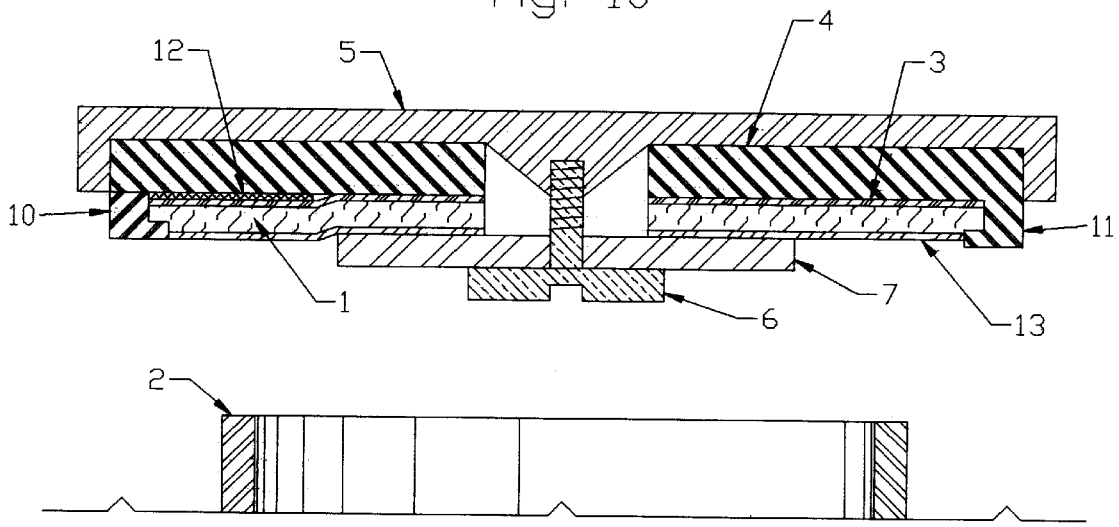
FIG. 10 is similar to FIG. 4 and shows a sealing surface that is adhered to the cushion that is in turn held in the cushion holder recess by a retaining lip on the side of the recess and a retaining washer/screw.

This invention can dispense with the retaining washer 7 and screw 6 as shown in FIGS. 7 and 8. These versions of the pad holder depend on an outer constricting side angle or lip 9 to retain the cushion within the cushion holder recess.

Figure 11:
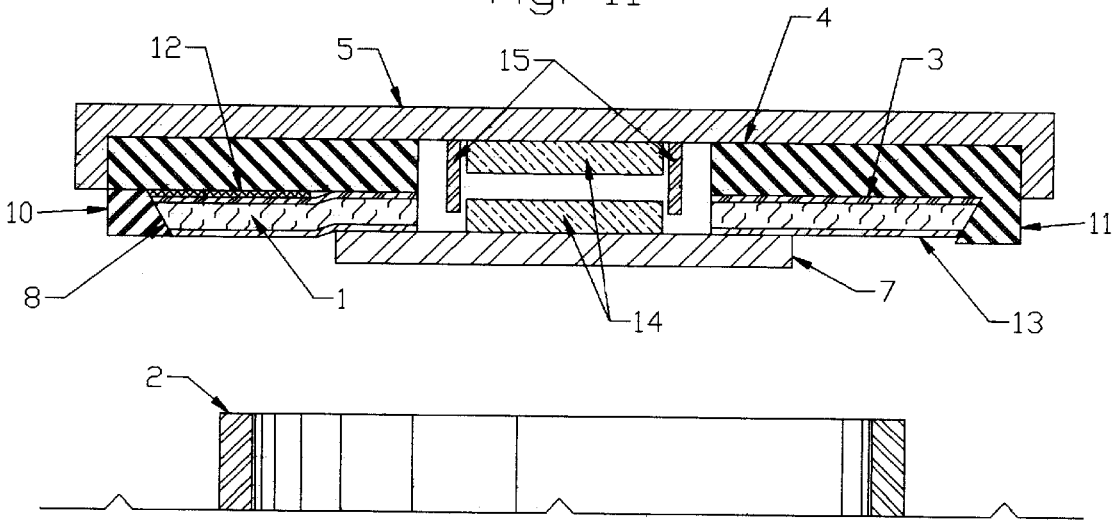
FIG. 11 is similar to FIG. 9 but shows a pair of attracting magnets being used as a fastening device to secure and retain the pad assembly within the cup.
Figure 13:
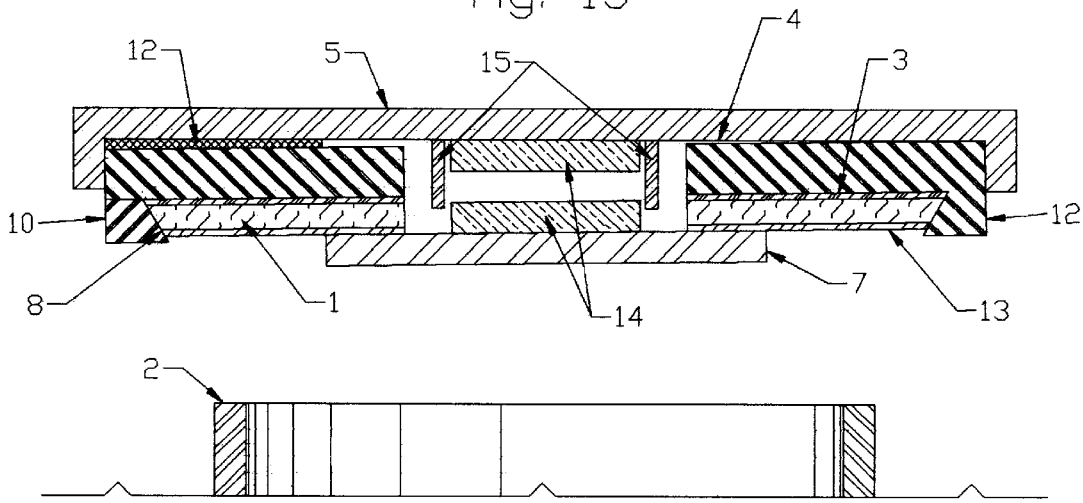
FIG. 13 is similar to FIG. 11 but shows a partial shim being placed between the back side of the cushion holder and the inside of the cup instead of between the cushion backing and the inside of the cushion holder recess.
Figure 1:
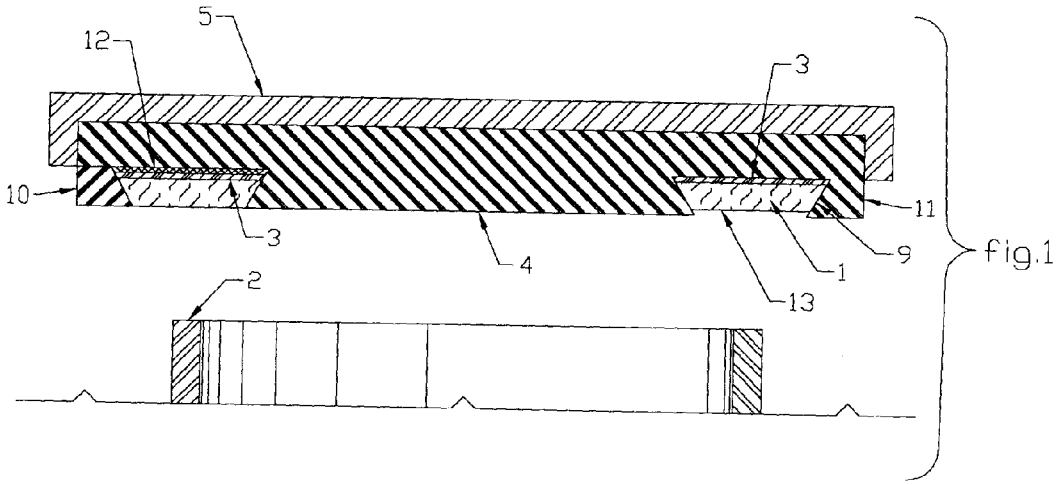
Figure 2:
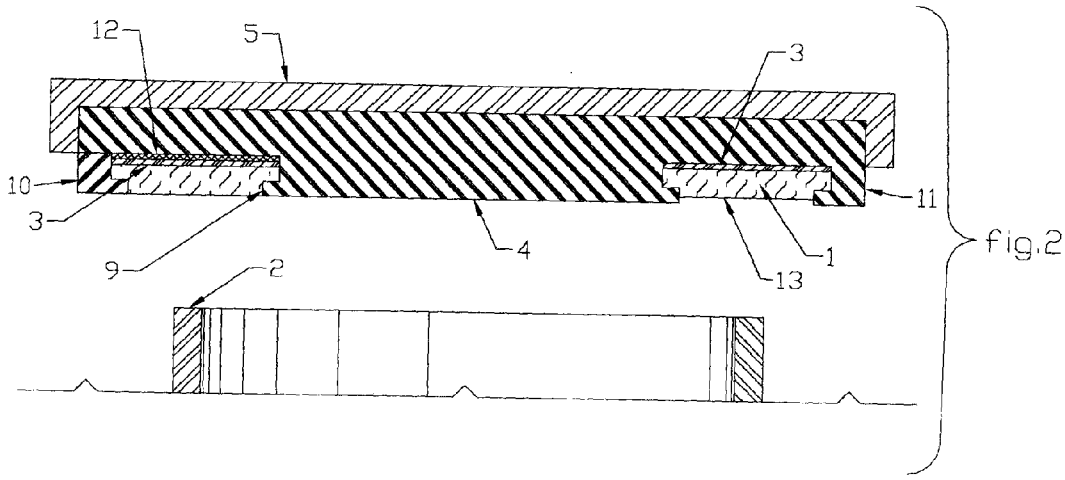
Figure 3:
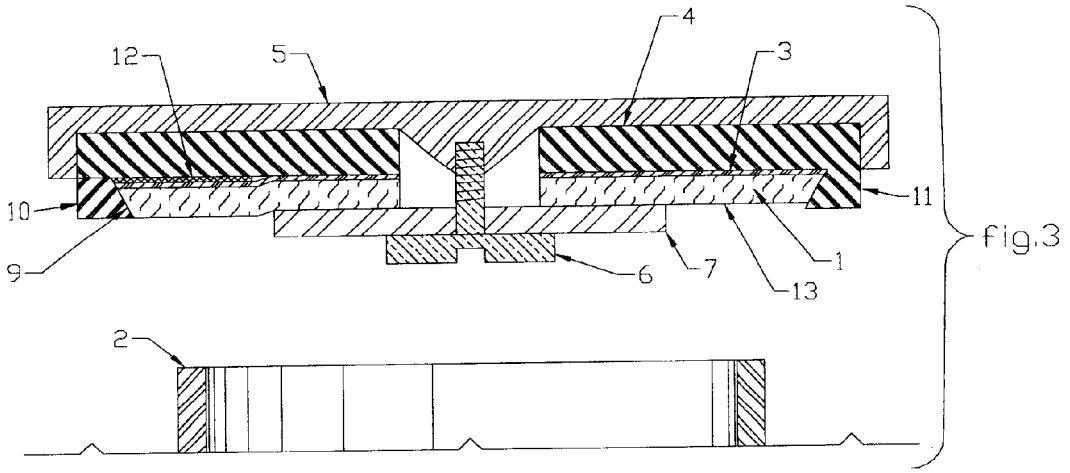
Figure 4:
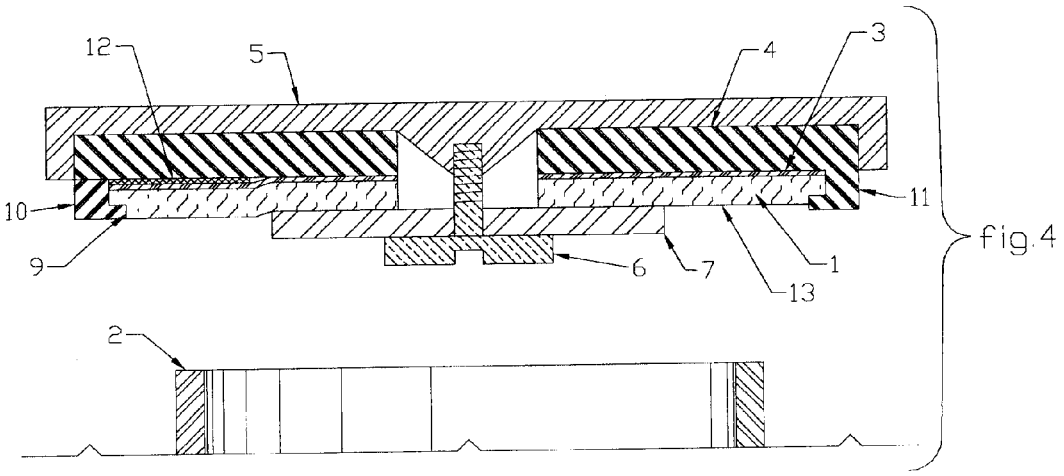
Figure 5A:
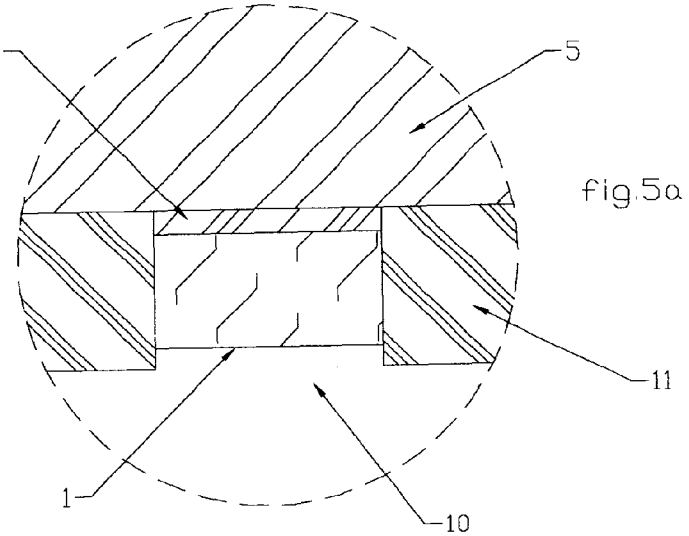
Figure 5:
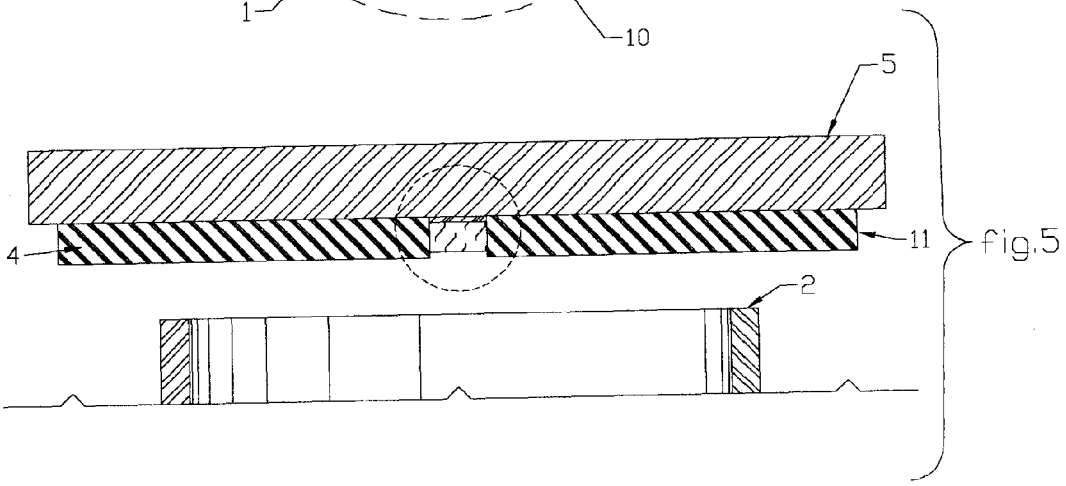
Figure 6:
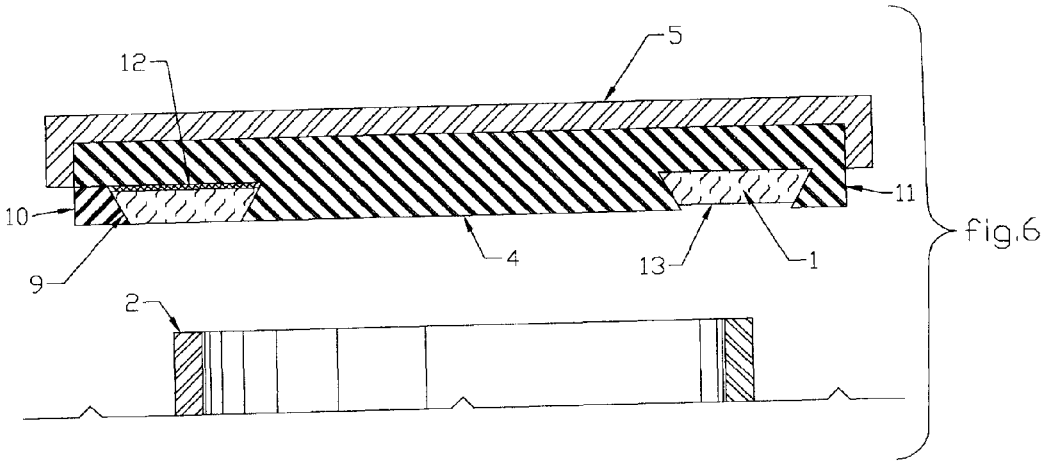
Figure 7:
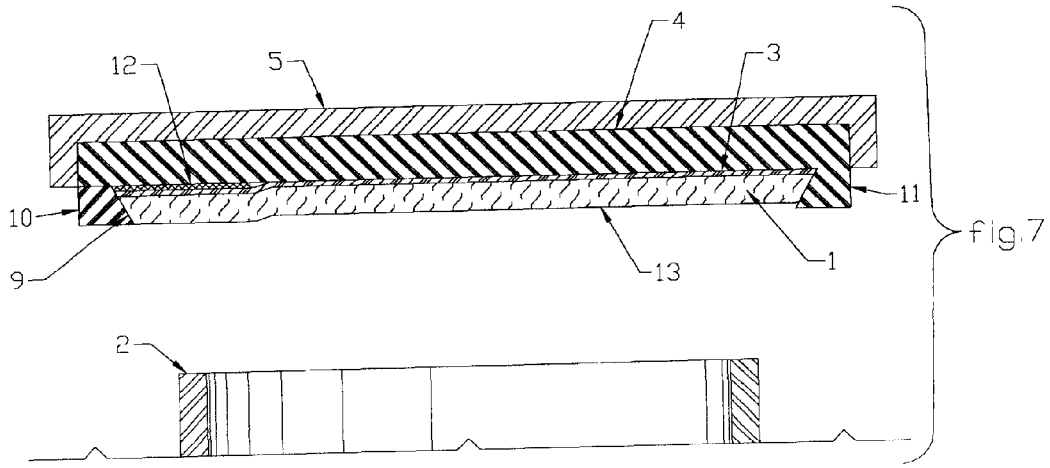
Figure 8:
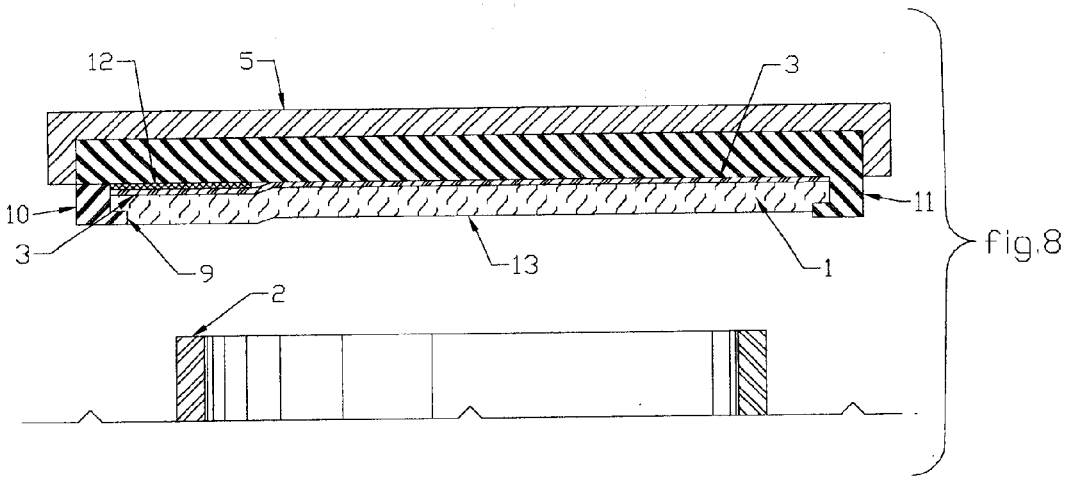
Figure 9:
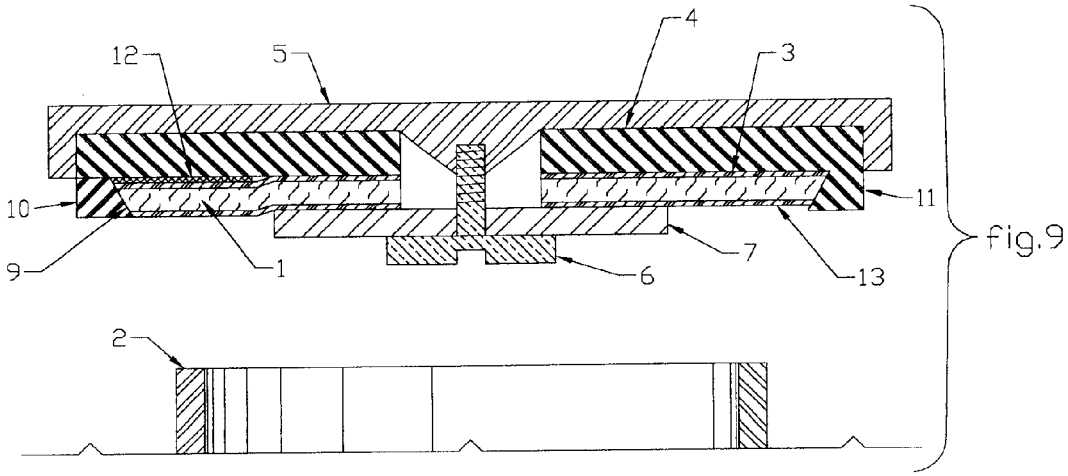
Figure 10:
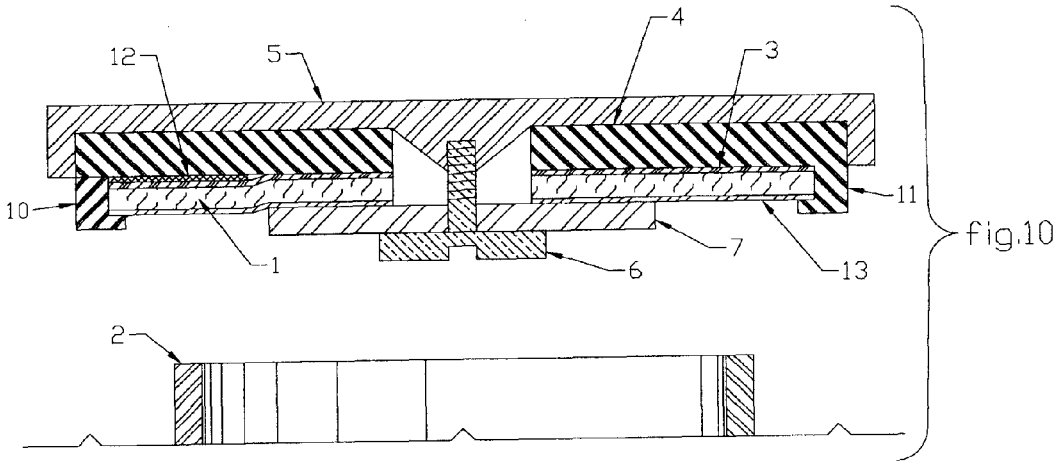
Figure 11:
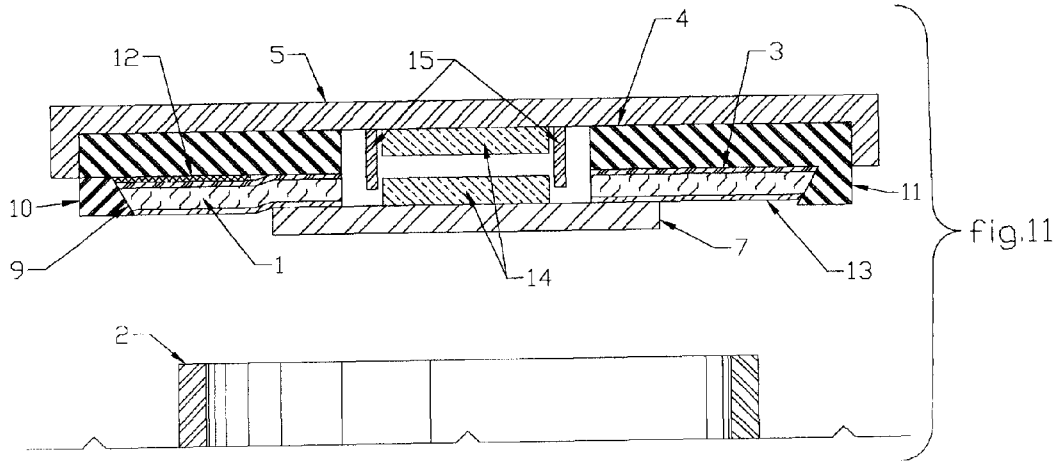
Figure 12:
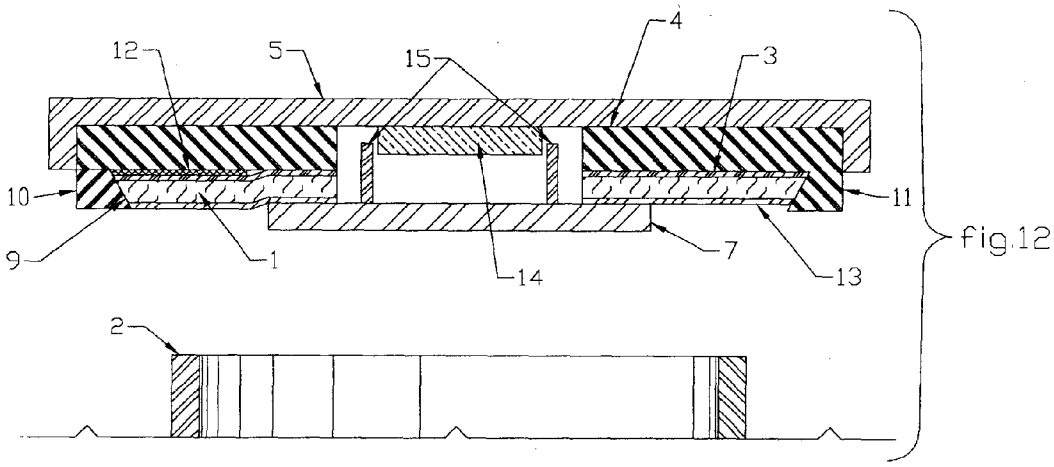
Figure 13:
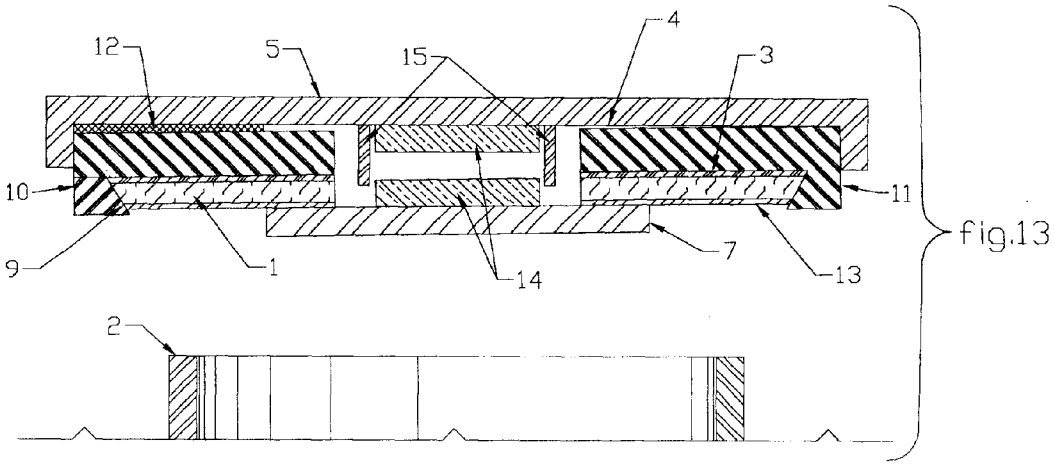

Referring now to FIGS. 11 and 13, we see a pad assembly wherein the central retaining screw has been eliminated and replaced with a pair of attracting magnets 14. The upper magnet is fastened to the inside of the cup 5 while the lower magnet is fastened to the retaining washer 7. A short tubular guide 15 is fastened to either the cup or to the retaining washer and serves to align the two magnets as well as to align the retaining washer with the center of the cup. The attracting force of the two magnets pulls the lower magnet along with the retaining washer that is attached to the lower magnet toward the upper magnet to hold the pad assembly securely within the cup 5. The two magnets 14 serve as a fastening device. By inserting a tweezers into the space between the pad and its corresponding tone hole rim 2, the retaining washer 7 along with its attached magnet 14 can be grabbed by the tweezers and removed from the pad assembly. With the retaining washer out of the way, the pad can easily be removed from the cup. The removed pad can be replaced with a new one and/or shimmed for the purpose of eliminating leaks between the pad and the rim of the tonehole. A tweezers can then be used to replace the retaining washer and its magnet, thus reassembling and securing the pad within the cup/key. This entire process can be performed without having to remove the cup/key from the musical instrument, thus saving time and expense.

Figure 12:
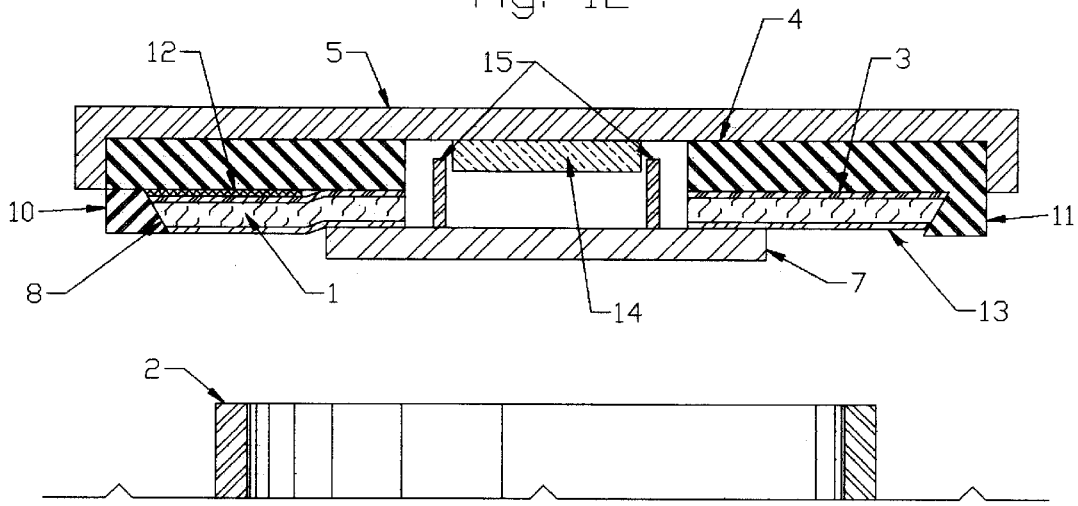
FIG. 12 is similar to FIG. 11 but shows a magnet being used to attract a metal retaining washer to secure the pad assembly within the cup.

FIG. 12 shows a pad assembly that uses only one magnet and a retaining washer as a fastening device. A magnet 14 is attached to the inside of the cup 5. A magnetically attractable metal retaining washer 7 is pulled toward the magnet by magnetic force, thus securing the pad assembly within the cup. A short tubular guide 15 is fastened to either the cup or to the retaining washer and serves to align the retaining washer with the center of the cup. A tweezers or similar tool can be used to remove the retaining washer 7 so that the pad can be replaced and/or removed for shimming without having to remove the entire cup/key assembly from the wind instrument.

FIG. 13 shows a shim 12 or partial shim that is placed between the rigid holder 4 of the cushion and the cup 7 for the purpose of eliminating leaks between a pad and the rim of its corresponding tonehole 2. A shim or partial shim 12 can also or alternatively be placed between the cushion backing 3 and the rigid holder 4 of the cushion as shown in FIGS. 11 and 12. Using the magnetic fasteners as described above, it is possible to replace or remove the shims from either location without having to remove the entire cup/key assembly from the wind instrument.

Figure 1:
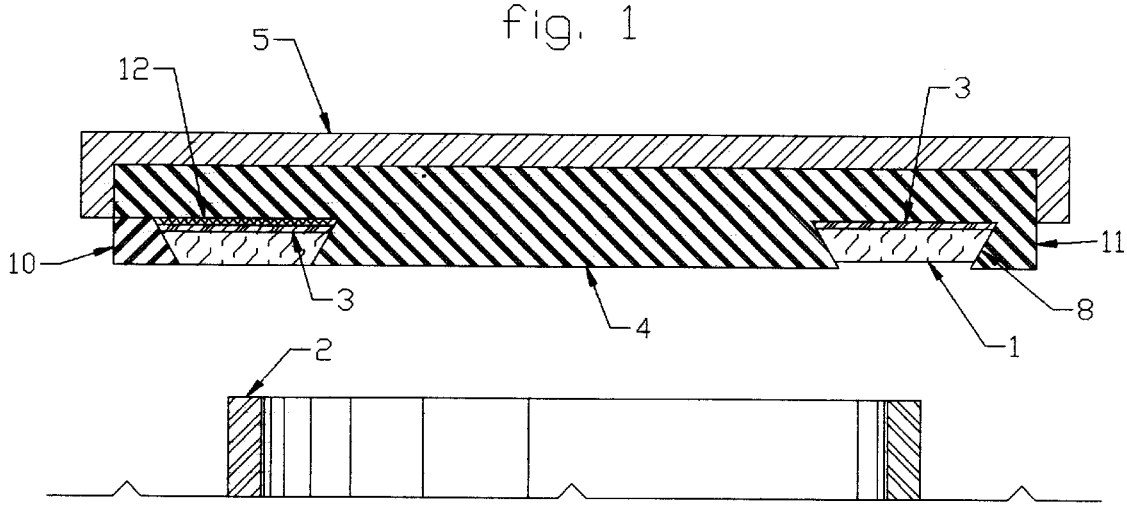
FIG. 1 is a cross sectional view of a pad and musical instrument tonehole showing the cup, cushion, cushion holder, and cushion holder groove/recess with inner and outer angular retaining lips partial shim, and cushion elevated at varying heights due to the partial shim.
Figure 2:
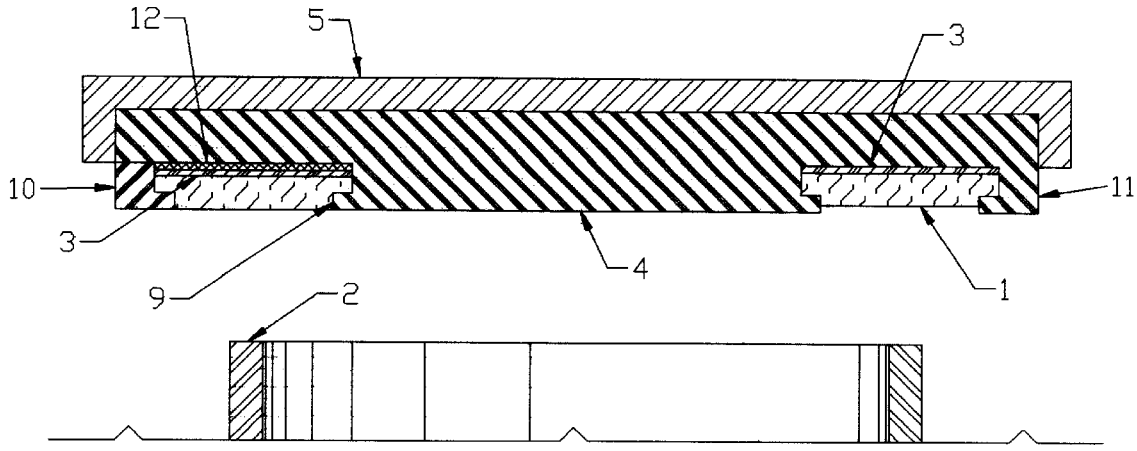
FIG. 2 is similar to FIG. 1 and shows an alternate version of the invention where a cushion holder groove with inner and outer retaining lips is being used to hold the cushion within the cushion holder recess.

FIGS. 1, 2 and 6 show a recess for a cushion that is groove shaped. With a groove shaped recess there can be a retaining lip or lips 9 or a constricting side angle or angles for the outside diameter of the ring shaped cushion as well as for the inside diameter of the ring shaped cushion. Because there is no central retaining washer or screw, a tool (such as a pick), can be used to partially or completely remove the pad from the groove for the purpose of replacing the pad or for installing or removing a complete or partial shim. This can easily be done without removing the cup/key from the instrument body. If a pad of the present invention were to become damaged, it could be replaced without disturbing the position of any shims 12 which were previously installed, thus saving any labor that went into shimming the original pad. Since these new pad cushions are dimensionally accurate, they can be substituted one for another within their original cushion holders without adversely altering the alignment between the pad cushion 1 and circumferential edge of the tonehole 2.

Referring now to FIGS. 9–13, a sealing surface 13 is shown bonded or adhered to an underlying cushion 1 such as ULTRASUEDE, felt, polyurethane foam such as is sold under the trademark of PORON, or other compliant material. The thin sealing surface can be made of a variety of materials such as films with polymeric structures, gut skin, leather or other. Some of the polymerically structured films available are more durable and reliable than leather or gut skin. Most polymerically structured films are impervious to air, provide an airtight seal and are unaffected by moisture. Using available adhesives, it is an easy matter to adhere these organic or synthetic films or skins to the tonehole sealing surface of the cushion. Adhering the sealing surface to the pad cushion offers an advantage in that the sealing surface does not have to wrap, stretch and distort around the cushion to be glued to the back side of the pad. Adhering the sealing surface 13 directly to the underlying cushion 1 helps to create a pad that has a flat surface free of distortion.

Another important consideration in pad design is the acoustical or sound reflecting qualities of the pad. Referring again to FIGS. 9–13, since the sealing surface 13 is bonded or adhered directly to the underlying cushion 1, most of the gaps between the sealing surface and the cushion are eliminated. This has the effect of restricting the movement of the sealing surface since no portion of the distinct, thin, lightweight sealing surface can move unless the heavier cushion moves along with it. Attaching the sealing surface directly to the cushion has the effect of making the sealing surface 13 more rigid without unduly stiffening the overall combination of the sealing surface/cushion. Because the sealing surface is stiffened, its dampening effect is reduced because it does not flex sympathetically with the vibration and air pulsations created when playing the wind instrument. All of this is achieved without reducing the desirable compliant nature of the pad cushion 1. Acoustic tests indicate that a stiffer pad-sealing surface is more sound reflective and thus preferable to a softer pad-sealing surface that absorbs and dampens the tone of a wind instrument in a negative way. It has also been determined that a slick sealing surface is more sound reflective than a rougher or more textured sealing surface. Many available polymerically structured films have a slick, sound reflective surface and can enhance the tone of a wind instrument. The proper combination of materials and design elements thus described results in a wind instrument pad with improved acoustic and mechanical properties.

Those skilled in the art will appreciate that the invention can be practiced by other means than the specific embodiments described above. Some specific features are shown in some drawings and not in others. It should be understood that each feature may be combined with any or all of the others in accordance with the invention. Many changes or modifications with respect to the construction and arrangement in practice thereof may be derived by those skilled in the art to which the present invention pertains. Accordingly it is emphasized that the invention is not limited to these embodiments, but encompasses other subject matter within the scope and spirit of the invention as set forth in the claims that follow.

I claim:

1. A valve pad for engaging with the tonehole rim of a musical instrument comprising:

a cushion, said cushion being held within a rigid holder, said rigid holder having a recess for receiving said cushion said rigid holder having at least one notch in its outer diameter to allow entry of a tool for prying said cushion out of said recess.

2. A valve pad for engaging with the tonehole rim of a musical instrument comprising:

a cushion, said cushion being held within a cup by a clamping means, said clamping means being a pair of attracting magnets.

3. A valve pad for engaging with the tonehole rim of a musical instrument comprising:

a cushion, said cushion being held within a cup by a clamping means, said clamping means being a magnetically attractable metal washer that is attracted to a magnet.

4. A pad assembly, receivable within a cup, for removable engagement with the tonehole rim of a musical instrument comprising:

a disc having a front surface for engaging said tonehole, a back surface removably disposed in said cup, and an outer circumferential edge between said front and back surfaces, said disc having a film adhered to the major portion of said front surface without covering said edge.

5. The assembly of claim 4 wherein a second film is adhered to said back surface.

6. The assembly of claim 4, said disc being a cushion, said film being elastic foam.

7. The assembly of claim 4, said disc being a fibrous material said film being open cell foam.

8. The assembly of claim 4, said disc being a fibrous material, said film having a polymeric structure.

9. The assembly of claim 4, said disc being a fibrous material, said film being gut skin.

10. The assembly of claim 4, said disc being a fibrous material, said film adhered to front surface being a polymeric material, said back surface being adhered to a second film of polymeric material.

11. The assembly of claim 4, said disc being a fibrous material, said film adhered to front surface being elastic foam, said back surface being adhered to a second film of polymeric material.

12. A pad assembly, receivable within a cup, for removable engagement with the tonehole rim of a musical instrument comprising:

a cushion holder for insertion into said cup, said holder having a rigid peripheral collar thereon said collar having an inwardly extending annular lip;

a compliant disc-shaped cushion removably inserted into said holder, said cushion having a first surface adjacent to said holder, an opposite second surface exposed to said tonehole, and a circumferential edge therebetween adjacent to said collar;

a film layer adhered to said second surface for sealing engagement with said tonehole rim, said annular lip covering the peripheral edge of said film when said cushion is inserted into said holder.

13. The assembly of claim 12 wherein a second film is adhered to said first surface.

14. The assembly of claim 12 wherein said film layer adhered to said second surface is comprised of a polymeric material and a second film of polymeric material is adhered to said first surface.

15. The assembly of claim 12 wherein said assembly is secured within said cup by a central clamping means.

16. The assembly of claim 12 wherein said holder has an inner collar thereon, said inner collar having an outwardly extending annular lip, said inner and outer collars forming a recess therebetween.

* * * * *

UNITED STATES PATENT AND TRADEMARK OFFICE

CERTIFICATE OF CORRECTION

PATENT NO. : 6,344,604 B1
DATED : February 5, 2002
INVENTOR(S) : Schmidt

It is certified that error appears in the above-identified patent and that said Letters Patent is hereby corrected as shown below:

Title page,
Showing an illustrative figure should be deleted and substitute therefore the attached title page.

Drawings,
Delete drawing sheet(s) 1-7, and substitute therefore the drawing sheet(s) consisting of Fig(s) 1-13 as shown on the attached pages.

Signed and Sealed this

Sixteenth Day of July, 2002

*Attest:*

*Attesting Officer*

JAMES E. ROGAN
*Director of the United States Patent and Trademark Office*

(12) United States Patent
Schmidt

(10) Patent No.: US 6,344,604 B1
(45) Date of Patent: Feb. 5, 2002

(54) PAD, PAD HOLDER AND FASTENER FOR WOODWIND MUSICAL INSTRUMENTS

(76) Inventor: James Edward Schmidt, 4480 N. Academy, Sanger, CA (US) 93657

( * ) Notice: Subject to any disclaimer, the term of this patent is extended or adjusted under 35 U.S.C. 154(b) by 0 days.

(21) Appl. No.: 09/608,432

(22) Filed: Jun. 30, 2000

Related U.S. Application Data

(60) Provisional application No. 60/142,424, filed on Jul. 6, 1999.

(51) Int. Cl.[7] ..... G01D 7/08
(52) U.S. Cl. ..... 84/385 P
(58) Field of Search ..... 84/385 P

(56) References Cited

U.S. PATENT DOCUMENTS

| | | | | | |
|---|---|---|---|---|---|
| 4,158,979 | A | * | 6/1979 | Suzuki | 84/385 P |
| 4,453,444 | A | * | 6/1984 | Valentino | 84/385 P |
| 4,704,939 | A | | 11/1987 | Straubinger | |
| 4,798,122 | A | * | 1/1989 | Gisler et al. | 84/385 P |
| 5,381,718 | A | * | 1/1995 | Wasser | 84/385 P |
| 5,417,135 | A | * | 5/1995 | Straubinger | 84/385 P |
| 5,469,771 | A | * | 11/1995 | Wasser | 84/385 P |
| 5,717,151 | A | * | 2/1998 | Straubinger | 84/385 P |
| 5,900,562 | A | * | 5/1999 | Smeding | 84/385 P |
| 6,028,256 | A | * | 2/2000 | Straubinger | |

* cited by examiner

*Primary Examiner*—Shih-Yung Hsieh

(57) ABSTRACT

A pad for closure of a musical wind instrument tonehole. The pad consists of a cushion that is contained within a rigid holder that has a recess with a lip (lips) or angular, constricting lateral side (sides) to secure the cushion within the holder. A notch is provided in the cushion's rigid holder that allows a tool to be inserted in order to pry out the cushion from the cushion holder so that shims may be easily installed and adjusted to obtain a precise seal between the pad surface and the tonehole rim. The shimming procedure can be performed without having to remove the cup/key and the pad from the wind instrument. An improved way of shimming pads, such as flute pads, by providing a pad fastening device which does not require removal of the pad closing mechanism from the instrument body. This is achieved by replacing the usual pad retining screw with a magnet that can easily be removed and replaced with a tweezers. The tone or acoustical properties of various pad materials and their manner of construction is of considerable importance. Reducing the detrimental sound absorbing qualities of pads by adhering a slick sealing surface directly to the underlying cushion further enhances the tone qualities of wind instruments.

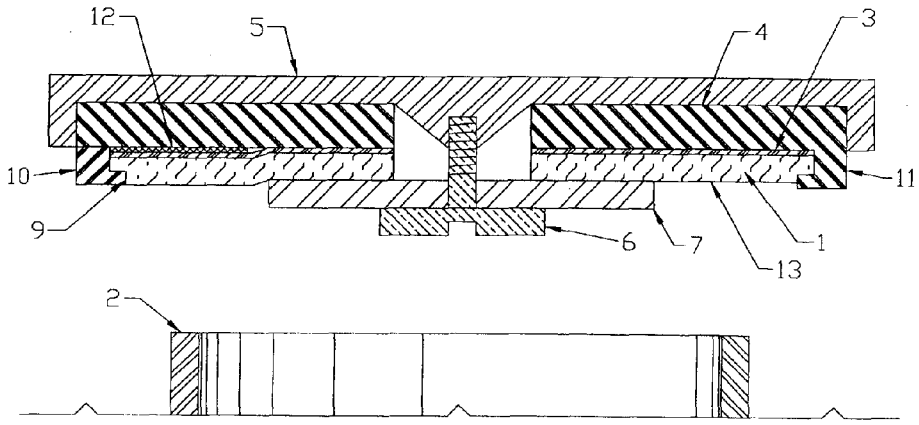

16 Claims, 7 Drawing Sheets